United States Patent [19]

Taylor

[11] Patent Number: 4,976,214

[45] Date of Patent: Dec. 11, 1990

[54] DOOR HARPS

[76] Inventor: Robert A. Taylor, 1180 High Valley Dr., Pigeon Forge, Tenn. 37863

[21] Appl. No.: 406,532

[22] Filed: Sep. 13, 1989

[51] Int. Cl.[5] ..... G08B 21/00; G10D 1/00

[52] U.S. Cl. ..... 116/100; 84/173

[58] Field of Search ..... 116/100, 141, 169, 85, 116/86, DIG. 12; 84/173, 290, 404, 408; 446/418, 422

[56] References Cited

U.S. PATENT DOCUMENTS

| | | | |
|---|---|---|---|
| 456,027 | 7/1891 | Ernst | 84/173 |
| 515,323 | 2/1894 | Carswell | 84/173 |
| 721,063 | 2/1903 | Mohr | 84/404 |
| 2,705,936 | 4/1955 | Garson | 116/100 |
| 3,780,612 | 12/1973 | Robinson | 84/173 |
| 4,126,072 | 11/1978 | Taylor | 84/173 |

FOREIGN PATENT DOCUMENTS

| | | | |
|---|---|---|---|
| 62030 | 4/1892 | Fed. Rep. of Germany | 84/173 |

*Primary Examiner*—William A. Cuchlinski, Jr.
*Assistant Examiner*—W. Morris Worth
*Attorney, Agent, or Firm*—Shlesinger & Myers

[57] ABSTRACT

A door harp having a body portion with a front face and a back and at least two spaced apart pegs mounted on the front face having a tensioned string extending between them and a pendulum like chiming device extending from a bracket mounted on the front face above the string in a position to strike the string when the door harp is moved. The door harp also includes a cavity formed in the back forming a resonance chamber and a sounding board. A groove extends from the bottom of the cavity towards the front face of the body portion and surrounds the sounding board.

7 Claims, 2 Drawing Sheets

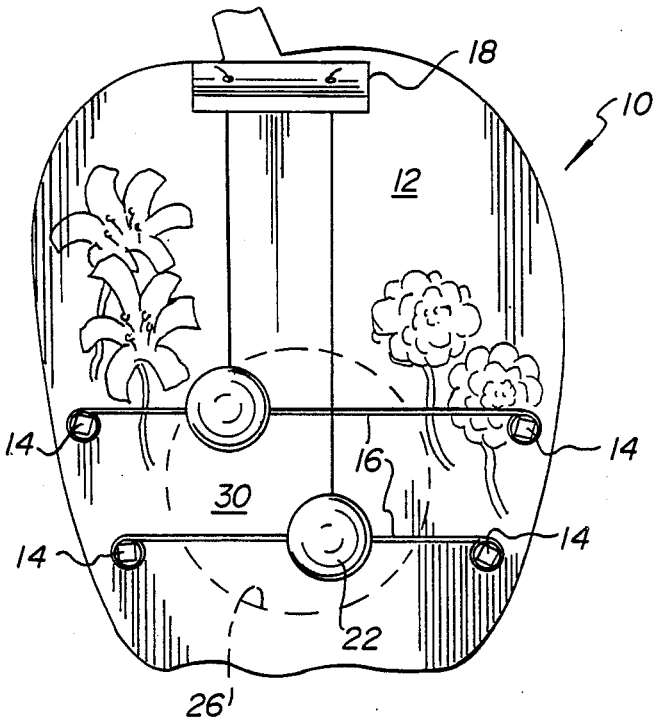
FIG. 1
FIG. 2
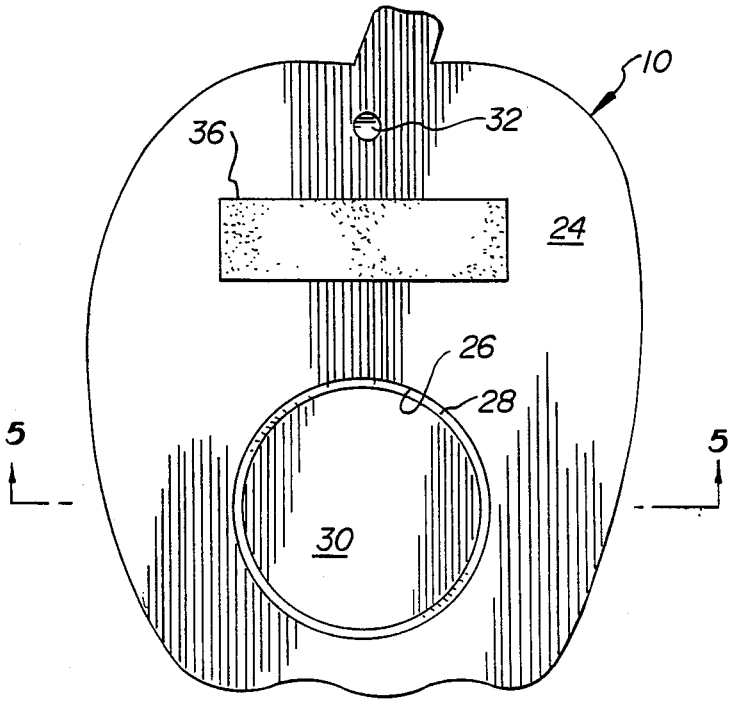
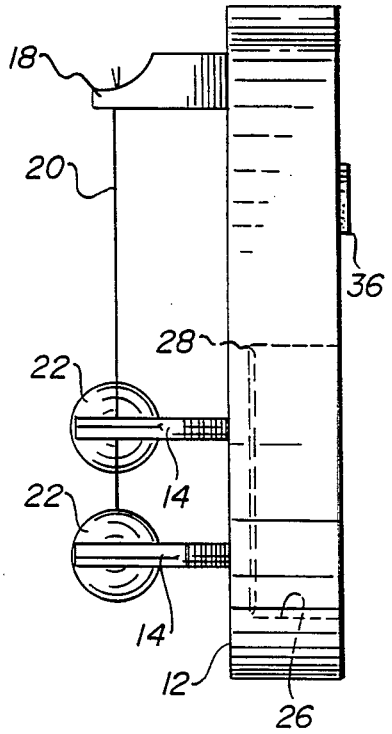
FIG. 3

DOOR HARPS

FIELD OF THE INVENTION

This invention relates to devices which are used to signal the opening and closing of a door by rendering a sustained musical signal.

BACKGROUND OF THE INVENTION

Door movement indicators which make a sound or noise to indicate the opening or closing, or movement of a door have been known and used in the art. It has been common to use bells or buzzers in public shops to indicate the presence of a customer and in homes to indicate the entrance and departure of guests or children. Devices using musical tones such as bells or even stringed devices have also been used. Stringed door movement indicators have taken the form of the strings being strung over a hollow resonant box similar to that used in a stringed instrument such as a guitar or a violin which has an opening or openings in the front thereof, and chime balls or clappers are suspended over the strings as in the patent to Garson U.S. Pat. No. 2,705,936. One of the disadvantages of the above described musical door movement indicators is that, while they can provide high quality tonal resonance, even a cursory inspection reveals a device which involves a considerable number of steps in the fabrication thereof to construct the resonance box. Further, the opening tends to be unsightly and subject to dust accumulation, etc.

In view of the above, it can be seen that there is a need for a device which achieves relatively high quality tonal resonance and can be manufactured simply and efficiently and inexpensively. The disclosed invention provides just such a device having a unique and revolutionary resonance producing feature to provide reduced construction costs.

OBJECTS AND SUMMARY OF THE INVENTION

The primary object of the disclosed invention is a door harp which emits relatively high quality sound signals when activated by the movement of the attached door.

Another object of the disclosed invention is to provide a door harp which is economical and simple to manufacture.

Yet another object of the present invention is to provide a unique sound resonating system.

Still another object of the disclosed invention is to provide a decorative door harp which may include indicia covering the entire face thereof.

Yet another object of the disclosed invention is to provide a door harp which has no recesses on the front thereof which might collect dust as opposed to the front openings on the prior art.

In summary, therefore, this invention is directed to a door harp which while being economical to manufacture, still provides a sounding board which delivers an acceptable quality of musical tone resonance.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is an elevational view of the door harp of the disclosed invention and showing by dotted line the hidden rear cavity.

FIG. 2 is an elevational view of the rear of the door harp showing the rear cavity and sounding board groove.

FIG. 3 is a side elevational view of the door harp of FIGS. 1 and 2 showing the rear cavity by dotted line.

DESCRIPTION OF THE INVENTION

Figure 4:
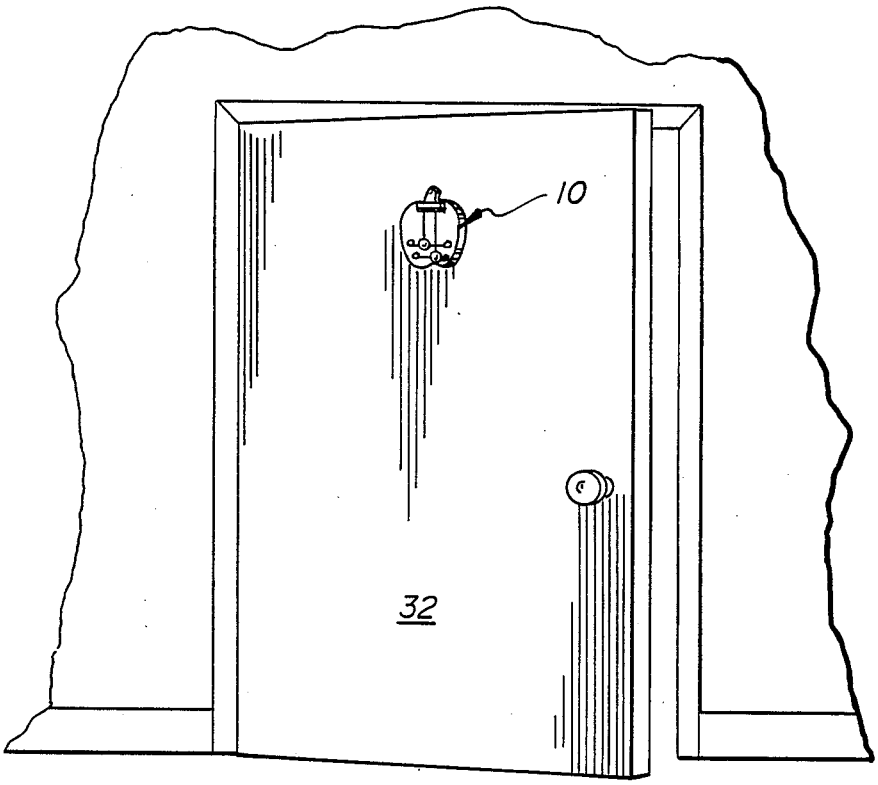
FIG. 4 shows the door harp mounted to a door in operative position.

Referring now to FIG. 1 a door harp 10 as contemplated by the present invention is shown. Door harp 10 has a front face 12 which is generally flat and may be formed around its perimeter in a decorative shape and may also include decorative indicia thereon. Door harp 10 further includes four threaded tuning pegs 14 which may be constructed of any suitably rigid material, but steel is preferred. Pegs 14 are preferably mounted about $\frac{1}{4}$ to $\frac{1}{2}$ inches from the side edge of door harp body 10 to provide secure anchors for strings 16 and prevent the wood from splitting. Pegs 14 are sized for rotational insertion a distance of about $\frac{5}{8}$ inches into door harp body 10 and extend outwardly from the front face 12 a sufficient distance to maintain strings 16 spaced above and parallel to the front face 12. Strings 16 extend between pegs 14 in a taut, tensioned manner. Strings 16 are preferably made of piano wire or guitar string type material which produces high quality musical tones. The strings 16 can be sized and adjusted to produce desired notes and are preferably spaced apart about $\frac{3}{4}$ of an inch.

Chime support bracket 18 is attached to the front face of door harp 10, vertically spaced from strings 16 when door harp 10 is mounted in proper operating position. Bracket 18 and door harp body 10 are preferably constructed of wood. Wood is a time honored material for use in musical sound reproduction instruments, but other materials such as plastics and metal may be used if proper tonal qualities can be obtained therefrom. Wood is also preferred for its ease of machining and its light weight. Lightness is a factor in use of the door harp in that it is intended to be suspended from a door.

Chime support bracket 18 preferably extends outwardly from front face 12 a greater distance than the displacement of strings 16 from front face 12 in order that elongated flexible supports 20 hang nearly vertically downward from the chime support bracket 18 and suspend chime balls 22 at locations where chime balls 22 may strike strings 16. Flexible chime balls supports 20 are preferably made of thin flexible material such as thread or string strong enough to support chime balls 20 in pendulum fashion. Each chime ball 22 is spaced vertically from the other in order that each chime ball 22 strikes only its own respective string 16. Chime balls 22 are preferably made of a harder wood than door harp body 10 in order to provide a clearer tone when balls 22 strike strings 14. Other materials such as glass or steel or the like may also be substituted, but a hard wood such as birch is preferred for economic and aesthetic reasons.

FIG. 2 shows the back side 24 of door harp 10 and clearly shows hollow cavity 26 and perimeter groove 28. FIG. 3 is a side view of door harp 10 and shows the vertical displacement between bracket 18 and chime balls 22 and shows the horizontal displacement between chime ball 22 and front face 12. While in FIG. 1, pegs 14 are shown as being placed on either side of door harp 10, FIG. 3 shows the pegs 14 being spaced between the perimeter of cavity 26 in order that strings 14 extend across cavity 26 for maximum resonant effect. Groove 28 is more clearly shown in FIG. 3 and serves to allow sounding board 30 to reverberate in a longer movement path and better amplify the sound created by chime balls 22 striking strings 16. Groove 28 is of paramount importance in reducing the rigidity of the connection between sounding board 30 and door harp body 10.

In the preferred embodiment door harp body 10 is about ¾ or an inch in thickness. Back 24 is hollowed out bY milling or drilling a distance which leaves a diaphragm or sounding board 30 of a thickness of about ⅛ of an inch. Groove 28 is further cut to allow sounding board 30 to reverberate in a wider range of movement. Groove 28 is about 1/16 of an inch deep and leaves a thickness to the front face 12 of about 1/16 of an inch. Groove 28 provides greater movement and resonance of sounding board 30 which results in improved tonal quality of the door harp 10. It should be understood that various modifications of the above dimensions may be used, especially if different materials are employed in construction of the door harp 10.

FIG. 4 shows the door harp 10 mounted to a door 32. Preferably door harp 10 includes a hole 34 to facilitate mounting on a nail or screw projecting from door 32. Door harp 10 may be affixed to the door by glue, tacks, nails, etc., or in the case of steel doors, a magnet 36 may be used.

Figure 5:
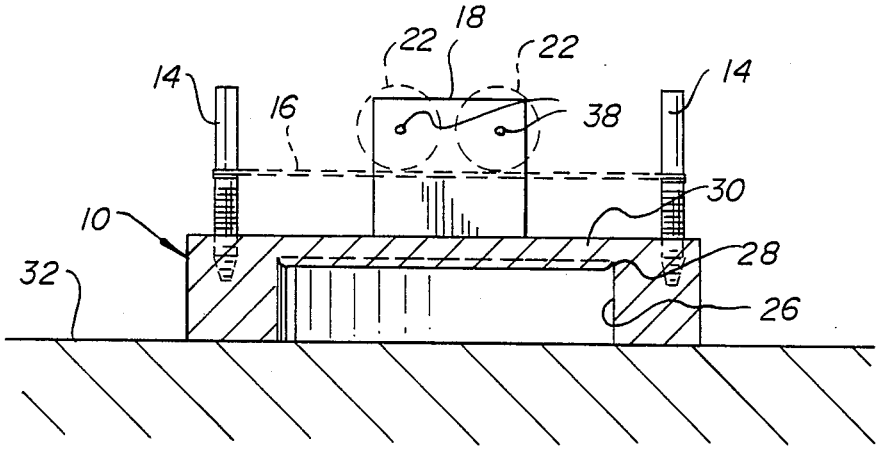
FIG. 5 is a cross sectional view of the door harp of FIG. 2 taken along lines 5—5 showing the strings held by pegs and the balls at rest against the strings and also showing a cut away view of the rear cavity.

FIG. 5 is a cross sectional view of door harp 10 taking along line 5—5 of FIG. 2. FIG. 5 taken in conjunction with FIGS. 2 and 3 shows the circumferential nature of groove 28 adjacent cavity 26 defining the sounding board 30. Cavity 26 is preferably about one and ¾ inches in diameter for a two string harp and about 3 inches for a three string harp. The length of strings 16 are about 3 inches for a 2¼ inch diameter hole and are about 4 inches for a 3 inch diameter hole. FIG. 5 also illustrates the location of the chime balls 22 and strings 16 when chime balls 22 are at rest and hanging vertically from support bracket 18. When wooden chime balls 22 are used, the balls 22 are drilled centrally in order to affix flexible chime ball support 20 thereto by insertion of the flexible support 22 through hole 38 and securing thereto as by tieing a knot. Cavity 26 is directly under the ball impact area of strings 16.

In operation door harp 10 is affixed to door 32 as shown in FIG. 4. The movement of door 32 operates door harp 10. When door 32 is either opened or closed, chime balls 22 swing away from door harp front face 12 and on their return strike strings 16. Since chime balls 22 are constructed of rigid material strings 16 are stretched taut, strings 16 vibrate to form a musical tone when chime balls 16 repeatedly strike their respective strings 16. This tone is amplified and given additional fullness through the use of a sounding board 30. Groove 28 around sounding board or diaphragm 30 allows more resonating action by sounding board 30 and further increases the tonal quality of the musical note produced by strings 16 when struck by chime balls 22. In order to get enough movement in the pendulum stroke of chime balls 22, it is preferable that the length of flexible chime ball support 20 be of at least 2 inches. Preferably the chime balls 22 and flexible chime ball supports 20 are positioned in relationship to strings 16 so that a chime ball 22 strikes a string 16 with maximum force directly over the cavity 26 to provide the best tone.

While this invention has been described as having a preferred embodiment, it is understood that it is capable of further modification, uses and/or adaptations which follow in general the principle of the invention and including such departures from the present disclosure as come within known or customary practice in the art to which the invention pertains, and as may be applied to the central features hereinbefore set forth, and fall within the scope of the invention and of the limits of the appended claims.

What we claim is:

1. A door harp comprising:

(a) a body of one-piece wood board construction;

(b) said body having a substantial thickness and having a face and a back;

(c) said back having a hollowed out cavity therein, leaving a relatively thin sounding board between said cavity and said face, said cavity having a side wall and a bottom wall;

(d) at least two spaced apart pegs attached to said body and extending outwardly from said front face;

(e) at least one string extending between said peg;

(f) said at least one string being spaced from said face;

(g) said pegs being located outside said cavity's perimeter;

(h) said string extending across said cavity;

(i) a chime ball;

(j) a chime ball supporting bracket attached to said body;

(k) flexible support means connecting said chime ball to said bracket and suspending said chime ball therefrom and swinging pendulum fashion to a location at which said chime ball may strike said string;

(l) said string being under tension to create a resonant sound when struck by said chime ball;

(m) a groove coextensive with the side wall of the cavity and extending from the bottom wall of the cavity toward the face further defining said sounding board.

2. The door harp of claim 1, wherein:

(a) said door harp includes more than one pair of pegs on said face;

(b) each of said pairs of pegs having a string extending between them; and, (c) said strings extending across said front face over said cavity.

3. The door harp of claim 1, wherein:

(a) said groove is half as deep as the thickness of said sounding board.

4. The door harp of claim 2, wherein:

(a) said front face having indicia thereon over said cavity.

5. A door harp comprising:

(a) a body portion;

(b) said body portion having a front face and a back;

(c) at least two spaced apart pegs mounted to said front face;

(d) a tensioned string extending between and joined to said pegs;
(e) striking means mounted to said body portion for contacting said tensioned string and producing a chime;
(f) a cavity formed in said back having side and bottom walls;
(g) said string extending above said front face and across said cavity;
(h) a sounding board is located between said cavity and said front face;
(i) said cavity having a perimeter; and,
(j) a groove coextensive with the side wall of the cavity and extending from the bottom wall of the cavity toward the face further defining said sounding board.

6. The door harp of claim 5, wherein:
(a) said cavity is circular.

7. The door harp of claim 6, wherein:
(a) the ratio of string length to cavity diameter is approximately one to 0.75.

* * * * *